United States Patent [19]

Fredon

[11] 4,100,777

[45] Jul. 18, 1978

[54] LOCKING DEVICES

[76] Inventor: Pierre André Gaston Fredon, Hameau des Tilleuls (Le coulon), 4, rue des Charmes, 94320 Thiais, France

[21] Appl. No.: 704,667

[22] Filed: Jul. 12, 1976

[30] Foreign Application Priority Data

Jul. 18, 1975 [FR] France ..... 75 22512

[51] Int. Cl.[2] ..... E05B 27/00; E05B 19/12

[52] U.S. Cl. ..... 70/363; 70/398

[58] Field of Search ..... 70/363, 397, 398, 395, 70/387, 399, 402, 403

[56] References Cited

U.S. PATENT DOCUMENTS

| | | | |
|---|---|---|---|
| 1,037,543 | 9/1912 | Russell | 70/398 |
| 1,387,442 | 8/1921 | Lee | 70/363 |
| 3,738,136 | | Falk | 70/363 |

FOREIGN PATENT DOCUMENTS

| | | | |
|---|---|---|---|
| 383,909 | 3/1908 | France | 70/400 |

*Primary Examiner*—Kenneth J. Dorner
*Attorney, Agent, or Firm*—Wigman & Cohen

[57] ABSTRACT

The disclosure relates to a key, which is dynamic, and a lock to be operated by the dynamic key. The key has a shaft with a key bit and a manual grip at opposite ends thereof. Mounted on the shaft is a bush spring loaded towards the key bit. A radial projection on the shaft engages a pair of mutually intersecting internal grooves in the bush, namely, one straight groove running parallel to the shaft axis and one annular groove encircling the shaft, so that when the bush is fixed the shaft can be constrained to move only parallel to its axis by engagement of the projection in the straight groove, and to move only rotationally about its axis by engagement of the projection in the annular groove. At its end facing the key bit the bush bears a number of pegs to be engaged in a corresponding number of holes in a fixed member of the lock. Located in and spring biased outwardly of these holes are two sets of pins. When the key is fully inserted in the lock, the pegs on the bush push the sets of pins back in the holes until the division between the two sets coincides with an interface surface between the fixed member of the lock and a rotor rotatably mounted thereto. The rotor also receives the key bit and can be turned by manual rotation of the key shaft which, when the key is thus fully inserted, is free to rotate in the bush, the radial projection being in this condition located in the annular groove and the bush being fixed by the engagement of the pegs in the holes in the fixed member of the lock.

14 Claims, 3 Drawing Figures

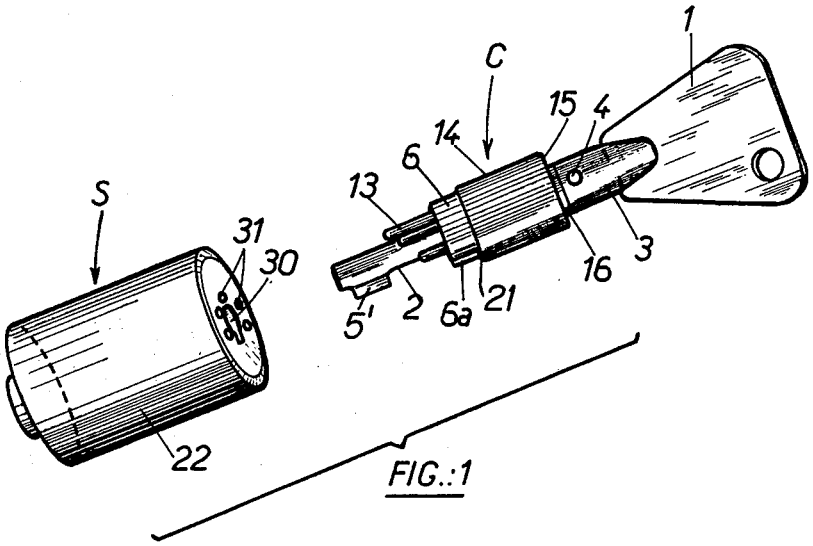
FIG.:1
FIG.:3
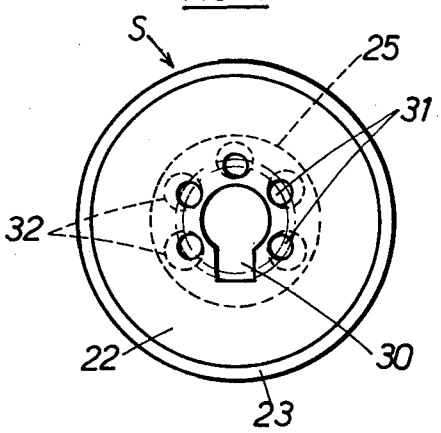

LOCKING DEVICES

Locking devices currently in use consist of two complementary parts which, although they are mechanically separate and distinct from one another, are so closely interrelated that together they form a combination which is supposedly exclusive, comprising:

a lock for permanent installation which has a movable end piece which can pass from an active locking position to a related unlocking position, and which is actuated, at least in so-called security locks, by the interposition of a rotary intermediate component (often called the "cylinder") associated with a locking system which is of more or less complicated design with a view to increasing the extent to which it is inviolable and exclusive, and a portable key with a configuration appropriate to the complexity of the locking system, with the twofold function of unlocking the rotary intermediate component and rotating it so as to operate the movable end piece to open or close the lock, as the case may be.

It will be clear that while the security of the mechanism doubtless depends on the unique design of the locking system and of the rotary intermediate component, it also and above all else depends on the difficulty of unlocking it without the appropriate key, while on the other hand the holder of the key must of course be able to use it to unlock the mechanism without the slightest difficulty. The determining factor for discrimination thus consists in the presence or abence of the appropriate key, corresponding to the lock in question, which is a truism it seems pointless to elaborate on.

Until now, the matching of a key to a locking system of singular design has consisted mainly, and in a word uniquely, in a particular and more or less elaborate configuration of the key, which is intended to confer on it the uniqueness required of it.

But however complicated this configuration may be, the fact that it has to be set up at least once, when machining the key originally supplied with the lock, means that it can be reproduced to make a duplicate, i.e. an exact copy, by any person skilled and equipped to carry out this type of work. This ability to reproduce the key is a convenient fact to which recourse is often had legitimately, but on the other hand it constitutes a failing in the very principle of security insofar as unauthorised persons and persons with evil intentions can profit from it, especially as the copying of keys seems to be inadequately covered by regulations and controlled by the authorities.

The present invention stems from the realisation of this deficiency and the object of the invention is, among other objects, a key of radically differnt design than conventional keys, which provides for stricter control of copying and even, should it prove necessary, the complete prevention of illicit copying.

As is well known, keys for conventional locks consist of a single, solid member comprising a grip attached to a stem which ends in a blade, which is placed in the keyhole of the corresponding lock to unlock the rotary intermediate component, which is entirely part of the lock, the key then being rigidly coupled to said component and causing it to rotate when the user turns the key. It will thus be seen that all the component parts which are movable relative to one another, and which might thus be termed the ∓dynamic" components, are incorporated in the permanently installed lock, while the portable key is, all things considered, a "static" component without any moving parts.

The key which is the object of the present invention is fundamentally different from such conventional keys, in that it consists of elements which are movable relative to one another in translation and/or rotation, the assembly constituting, as it were, a "dynamic" key in which the relative positions of the component parts change during operation of the corresponding lock. It therefore comprises, in addition to the basic blade member, which is matched to a corresponding rotor of the lock, an auxiliary member which is closely associated with the former but which is matched with a corresponding stator in the lock, so that on operating the lock the auxiliary member remains stationary while the blade member turns.

The key further comprises a system for locking the basic blade member to the auxiliary member associated with it, when the key is not in use, so as to prevent relative rotation of these two members, the arrangement being such that introducing the key into the corresponding lock causes the system to be unlocked and enables the blade member to rotate relative to the auxiliary member.

In one embodiment of the key, the auxiliary member which is matched with the corresponding stator of the lock can move in translation relative to the blade member when the key is introduced into the lock, and as a result moves from a rest position in which it locks the two members to one another to prevent relative rotation thereof, to an unlocked working position, such movement advantageously taking place against a resilient return force. In more detail, the auxiliary member comprises a bush which can slide on the blade stem against the action of a return spring, and which can rotate on the stem as soon as it is disengaged by such sliding movement from a rest positon in which it is keyed to the blade stem. A sleeve mounted on the stem protects the sliding rotary bush and its return spring.

In accordance with an important technical characteristic of the invention, the bush is so designed that on introducing the key into the corresponding lock the bush carries out the following operations, either in succession or at the same time:

(a) it unlocks the system for locking the rotor of the lock, which is then free to turn with the blade to operate a member at the end of the lock mechanism for engaging or releasing the lock, while the bush is coupled and locked to the stator of the lock; and (b) it moves from its keyed position on the blade stem and is thereby freed therefrom, which allows said blade stem to turn relative to the stator of the lock and drive the rotor of the latter.

In one embodiment of bush, it has a series of pegs with various predetermined lengths parallel to the direction in which the key is introduced into the corresponding lock. The lock has holes which are arranged in the same pattern as the pegs and in which the respective pegs engage to unlock the system for locking the rotor of the lock, and the locking system may consist of an appropriate set of pins and counter-pins, or other components currently used in conventional locks.

Briefly, in comparison with conventional locking devices in which the permanently installed lock contains with whole of the non-rotating or stator compartments as well as the whole of the "combination", i.e. the locking members, the locking device in accordance with the present invention is characterised in particular in that some of the non-rotating or stator components and some of the locking members are on the portable key, and thus supplement the blade to participate in the operation of the lock.

The following description, which is given by way of non-limiting example and with reference to the accompanying drawings, will explain how the invention may be carried into effect.

FIG. 1 is a perspective view showing a key in accordance with the present invention, facing the corresponding lock.

FIG. 3 is a diagrammatic end view of the lock.

Figure 2:
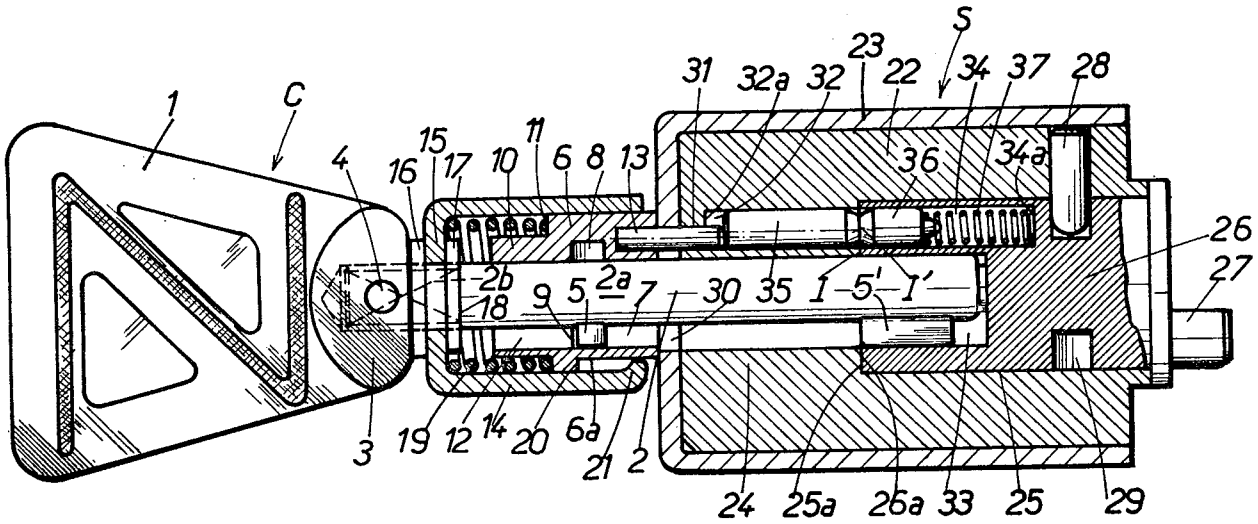
FIG. 2 is a longitudinal cross-section showing the key engaged in the lock and ready to operate it.

The key, of which one embodiment is shown, is generally referenced C, the corresponding lock body being generally referenced S.

The key C is a structured device made up by assembling together the following various component parts:

1. A rigid assembly formed by a flat grip 1 to which an operative blade stem 2 is attached by means of a boss 3 with a diametral locking pin 4, the stem 2 having a projecting rectangular lug 5 (FIG. 2) acting as a runner (see below) and a lug 5' for driving the lock rotor.

2. An operative member or bush 6 slidably mounted for relative longitudinal movement on the blade stem 2, in the cylindrical inside surface of which are two slideways at right angles to one another and matching the runner 5, namely a straight groove 7 along a generatrix in which the runner 5 slides to guide the stem 2 in the bush 6 in axial translation without rotation, and a circular groove 8 along a directrix in which the runner 5 slides to guide the stem 2 in the bush 6 in rotation without axial translation, the two grooves 7 and 8 intersecting at 9 to allow the runner 5 to pass from one to the other. On the side towards the grip 1, the bush is extended by a stepped ring of smaller diameter 10 which forms an annular shoulder 11 and has a slot 12 aligned with and of the same width as the straight groove 7. On the side opposite the grip 1, the bush 6 has a series of pegs 13 arranged in a particular pattern and extending parallel to the axis of the blade stem 2, with various predetermined lengths. In the example in question, the pegs 13 are five smooth pins arranged equidistantly around a circle, which is a relatively simple pattern, although it will be obvious that the pattern may be made as complicated as required.

3. A sleeve 14 surrounding bush 6, which slides freely in it, with an apertured round bottom 15 through which the stem 2 passes in a freely rotatable manner, but which is keyed to the stem in the axial direction by means of two washers 16 and 17 between which the bottom 15 of the sleeve 14 is sandwiched; namely, an outer washer 16 located between the boss 3 and the bottom 15, and an inner washer 17 located between the latter and a shoulder 18 on the stem 2 at the point where its cylindrical body portion **2*a* joins with its flattened end portion 2*b***.

4. A coil spring 19 located around the stepped ring 10 and housed in the sleeve 14, with its ends abutting against the circular bottom 15 and the annular shoulder 11 of the bush 6, respectively, so that telescoping of the latter into the sleeve 14 (the position shown in FIG. 2) compresses the spring 19, which urges the bush 6 outwards. To prevent the bush 6 being ejected from the sleeve 14 by the relaxation of the spring 19, a recessed shoulder 20 is formed on the body of the bush 6 by means of a flat **6*a*, and serves to limit outward movement of the bush in co-operation with an inwardly bent portion 21 of the edge of the open end of the sleeve 14**.

The key C which has just been described has of course a corresponding locking device S in which a rotor defining a movable latch actuator portion and a stator defining a stationary portion can be distinguished, in the usual manner.

In the embodiment shown in the drawings, the stator of the lock is a thick cylindrical block 22 of brass, which may be surrounded with a case-hardened steel cover 23 (shown in FIGS. 2 and 3 but not in FIG. 1). This block 22 is cast with a thick bottom portion 24 on the outside of the lock (i.e. towards the front), while on the inside (i.e. towards the rear) is a cylindrical bore 25 for receiving the body 26 of the rotor. The rotor 26 slides freely in the bore 25 and is attached to a spigot 27 for actuating a bolt (not shown). The rotor 26 is keyed axially to the stator bore 25 by a radial finger 28 which engages in a peripheral groove 29 in the body of the rotor 26 and is locked in place by the cover 23. By way of modification, the finger 28 may be replaced with a transverse plate. The rotor 26 can thus rotate in the bore 25, the bottom **25*a* of which is practically touching the circular inside end face 26*a* of the rotor. In FIG. 2, I designates the circular interface which separates the rotor 26 from the thick bottom portion 24 of the stator 22**.

This thick bottom portion 24 has several holes passing through it, all of which are parallel to the axis of rotation, namely:

(a) an irregular central hole 30 which is the image of the end view of the blade of the key C, for receiving the key in the usual way, and, around this, (b) a series of small circular holes 31 forming the image of an end view of the pegs 13 of the key C and arranged very accurately in the same pattern as the latter, each of the small holes 31 opening into a cylindrical bore 32 of larger diameter so as to form a shoulder **32*a*** at their junction.

The body of the rotor 26 also comprises holes parallel to the axis of rotation, but these are blind holes, namely:

(a) an irregular central hole 33 which, with the rotor in its angular rest position, coincides with the corresponding hole 30 in the stator, and, around this, (b) a series of cylindrical bores 34 which, in the angular rest position of the rotor, coincide with the respective corresponding holes 32 in the stator, which have the same diameter.

In each pair of corresponding bores 32–34, which open into one another at the interface I separating the rotor from the stator, are successively located from front to rear (from left to right in FIG. 2):

- a cylindrical pin 35,
- a cylindrical counter-pin 36 of the same diameter (that of the bores), and
- a coil or leaf spring 37 bearing on the bottom **34*a* of the blind hole 34 and on the counter-pin 36, to maintain the latter in contact with the pin 35**, the contact interface of these two components being referenced I'.

It should be noted that, as in cylinder security locks, the pins and counter-pins are of various predetermined lengths, the selection of lengths constituting what might conveniently be called the "combination" of the lock. These pins and counter-pins comprise lock control means for selectively locking the stator and rotor in a rest position when the lock is not engaged by a key and unlocking the stator and rotor in a work position with the key engaged in the lock.

When the lock is "at rest", without the key in it, each spring pushes parts 35 and 36 forward (i.e. towards the left in FIG. 2), the pin 35 abutting against the shoulder 32*a* in the bore 32 in the stator, while the counter-pin 36 takes up a position in which it passes through the interface I separating the stator from the rotor. In this rest position (not shown) the counter-pins 36 therefore lock the rotor 26 to the stator 22. As the rotor cannot turn, the lock cannot be made to operate.

To achieve this, the appropriate key C must be introduced into the lock. The blade of stem 2 enters the irregular central hole 30 while the pegs 13 engage in the respective holes 31 and then enter the bores 32 to act on the pins 35, which are pushed back (towards the right in FIG. 2) with their respective counter-pins 36, against the spring 37.

In a first stage of introducing the key C, the free face of the bush 6 is pressed against the front face of the stator block 22 (or its cover 23, as the case may be). At this time, the pegs 13, the lengths of which correspond to those of the pins 35, have moved the latter to a position such that all the contact interfaces I' coincide with the interface I separating the stator from the rotor, that is the counter-pins 36 are no longer positioned so that they pass through the interface I. The rotor is then unlocked from the stator and can rotate (the position shown in FIG. 2), while the bush 6 of the key C is, so to speak, dogged to the stator 22 of the lock S by the pegs 13 engaged in the latter and the bush 6 and stem 2 are locked together in this position of relative longitudinal movement between them.

As introduction of the key C into the lock S proceeds, in a second stage following abutment of the bush 6 against the stator 22, and cover 23 the blade stem 2 enters further and the lug 5 slides in the rectilinear groove 7 in the bush 6 until it reaches the intersection 9 of this groove with the circular groove 8 of the bush (position shown in FIG. 2), the bush 6 then telescoping into the sleeve 14 and compressing the spring 19. The blade stem 2 is then unlocked from the bush 6 in this position of relative longitudinal movement between them and can turn, the lug 5 driving the rotor 26 and thereby actuating the lock.

The sequence of events which has just been described is repeated in reverse when the key C is disengaged from the lock S.

It will be noted that in the present invention the rotor 26 of the lock is wholly to the rear of the latter and is in no way visible from the front, from which it is separated by the shield formed by the thick bottom portion 24 of the stator 22, whereas in currently available security locks the rotor is accessible from the front face, which exposes it to tampered.

The key shown in the drawings has a very simple blade, but it is obvious that this could be made more complicated, the ability to do this being part of the locksmith's art. Likewise, it is easy to make a master key by fitting intermediate elements.

It goes without saying that the embodiment described is only an example, and that it can be modified without departing from the scope of the invention, in particular by substituting technical equivalents.

I claim:

1. A combination of a key and a lock, said key comprising:

a shaft;

a manual grip at one end of said shaft;

a key bit at the other end of said shaft;

a radial projection extending from said shaft between said grip and said bit;

a bush mounted on said shaft and defining a translation groove for said projection and a rotation groove for said projection, said grooves intersecting one another and receiving said projection;

a plurality of pegs on said bush and extending parallel to said shaft towards said key bit; and means for resiliently urging said bush to a locking position in which said projection engages only said translation groove which extends parallel to said shaft, said rotation groove extending circumferentially of said bush; and said lock comprising:

a stator member defining a key entry passage shaped to receive said key bit and said shaft and also defining a corresponding plurality of parallel passages shaped and arranged to receive said plurality of pegs;

a rotor member mounted to said stator member and shaped and arranged to receive said key bit and the respective end of said shaft and to be rotatable thereby relative to the stator member;

a corresponding plurality of resiliently outwardly biased pins mounted in said rotor member to engage in said plurality of parallel passages and thereby lock said rotor member to said stator member;

a further plurality of pins in said parallel passages to abut said first said plurality of pins, said pegs being of such lengths that when said key is engaged with said lock so as to locate said radial projection in said rotation groove and thereby render said shaft free to rotate relative to said bush, said pegs urge said pluralities of pins in positions such that said rotor member is free to rotate relative to said stator member; and lock actuating means mounted to said rotor member.

2. A key device for operating a lock of the kind having a stationary portion, a movable latch actuator portion associated with said stationary portion for operative movement relative thereto, and displaceable lock control means associated with both said portions for selectively locking one portion to the other portion when said lock control means is in a rest position and unlocking said one portion from the other portion when said lock control means is displaced to a work position, said key device comprising:

a first component comprising an operative stem having means thereon for mating with said movable latch actuator portion;

a second component mounted for relative longitudinal movement on said first component and comprising an operative member having means thereon for mating with said stationary portion and for displacing said lock control means from said rest position to said work position thereof; and means on said first and second components and coacting therebetween for selectively locking said components against rotational movement relative to each other in a first position of relative longitudinal movement therebetween and unlocking said components for rotation relative to each other in a second position of relative longitudinal movement therebetween.

3. A key device as claimed in claim 2, further comprising resilient means extending between said components for urging said operative member of said second component to said first position of relative longitudinal movement with respect to said operative stem of said first component.

4. A key device as claimed in claim 3, wherein said first component further comprises a casing on said stem, said casing housing said resilient means and at least a part of said operative member of said second component.

5. A key device as claimed in claim 4, further comprising means on said casing for limiting the longitudinal movement of said operative member with respect thereto.

6. A key device as claimed in claim 2, wherein said mating means of said first component includes means for rotating said movable latch actuator portion of said lock, and wherein, in said first position of relative longitudinal movement, said second component is locked against rotation relative to said stem by said coacting means and, in said second position of relative longitudinal movement, said second component is unlocked by said coacting means for rotation relative to said stem.

7. A key device as claimed in claim 6, wherein said coacting means locks said second component against rotation relative to said stem during relative longitudinal movement of said second and first components between said first and second positions and excluding said second position.

8. A key device as claimed in claim 7, wherein said coacting means locks said components against relative longitudinal movement when said components are rotated relative to each other at said second position.

9. A combined locking system comprising:

a lock comprising a stator, a latch actuator rotor associated with said stator for operative rotation relative thereto, and displaceable lock control means associated with both said stator and rotor for selectively locking said rotor to said stator when said lock control means is in a rest position and unlocking said rotor from said stator when said lock control means is displaced to a work position; and a key comprising an operative stem having drive means thereon for mating with and rotating said rotor, an operative member having means thereon for mating with said stator and for displacing said lock control means from said rest position to said work position, said operative member being slidably fitted on said stem for relative longitudinal displacement with respect thereto between a first position and a second position and means on said stem and member and coacting therebetween for locking said stem and member against relative rotation in said first position and unlocking said stem and member for relative rotation in said second position.

10. A locking system as claimed in claim 9, wherein said coacting means locks said stem and member against relative longitudinal displacement when said stem and member are rotated relative to each other at said second position.

11. A locking system as claimed in claim 10, wherein said operative member of said key is longitudinally displaced slidably on said operative stem from said first to said second position by engagement of said member with said stator upon introduction of said key into said lock.

12. A locking system as claimed in claim 11, wherein said key further comprises spring means urging said operative member longitudnally to said first position from said second position upon withdrawal of said key from said lock.

13. A locking system as claimed in claim 9, wherein said lock control means comprise at least one pair of pins slidable parallel to the rotational axis of said rotor, and wherein said mating means comprises at least one peg protruding parallel to said axis from said operative member and engageable with said pair of pins upon introduction of said key into said lock.

14. A locking system as claimed in claim 13, comprising a plurality of pairs of pins in said lock and a number of pegs corresponding to the number of pin pairs on said key for simultaneous respective engagement therewith.

* * * * *